US008100076B1

(12) United States Patent
Shivers, III et al.

(10) Patent No.: US 8,100,076 B1
(45) **Date of Patent: *Jan. 24, 2012**

(54) LIQUEFIED NATURAL GAS PROCESSING AND TRANSPORT SYSTEM

(75) Inventors: Robert Magee Shivers, III, Houston, TX (US); William T. Bennett, Jr., Houston, TX (US); David Trent, Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/025,459

(22) Filed: Feb. 11, 2011

(51) Int. Cl.

| | |
|---|---|
| ***B63B 21/00*** | (2006.01) |
| ***B63B 22/02*** | (2006.01) |
| ***B63B 22/26*** | (2006.01) |
| ***B63B 25/08*** | (2006.01) |
| ***B63B 35/44*** | (2006.01) |
| ***F17C 7/02*** | (2006.01) |
| ***F25J 1/00*** | (2006.01) |

(52) U.S. Cl. ..... 114/230.14; 114/230.15; 114/230.17; 114/264; 441/5; 62/50.1; 62/611; 141/387

(58) Field of Classification Search ..... 114/230.1, 114/230.13–230.18, 74 R, 264; 441/3–5; 62/50.1–50.7, 53.2, 611–614; 137/615; 141/279, 387, 388; 414/137.1–138.2
See application file for complete search history.

(56) References Cited

U.S. PATENT DOCUMENTS

| | | | | |
|---|---|---|---|---|
| 3,155,069 | A * | 11/1964 | Ross et al. | 114/230.19 |
| 4,041,721 | A * | 8/1977 | Kniel | 62/53.2 |
| 4,315,533 | A * | 2/1982 | Eagles | 141/387 |
| 4,494,475 | A * | 1/1985 | Eriksen | 114/230.14 |
| 4,735,167 | A * | 4/1988 | White et al. | 114/230.14 |

* cited by examiner

*Primary Examiner* — Ajay Vasudeva
(74) *Attorney, Agent, or Firm* — Buskop Law Group, PC; Wendy Buskop

(57) ABSTRACT

A station and transport system for receiving, storing, and transporting liquefied natural gas is disclosed herein. The system can include a transport vessel, a floating liquefied natural gas processing station with a heat exchanger for receiving the dry gas from a pretreatment source and forming liquefied natural gas using a natural gas liquefaction train, a primary quick connect/disconnect device, a secondary emergency disconnect device, and a tertiary emergency disconnect device mounted to a station hull to allow quick connect/disconnect or emergency disconnect of the floating natural gas processing station from the transport vessel. The system can include a soft yoke with at least two telescoping soft yoke mooring arms, a boom, and a jib that form a gangway to safely hold the floating station to the transport vessel and to move personal and loads.

22 Claims, 12 Drawing Sheets

LIQUEFIED NATURAL GAS PROCESSING AND TRANSPORT SYSTEM

FIELD

The present embodiments generally relate to a natural gas processing station and transport system.

BACKGROUND

A need exists for a system configured to provide processing of natural gas into liquefied natural gas.

A need exists for a system for offshore transfer of liquefied natural gas to a transport vessel, and for transport of liquefied natural gas to another location.

A need exists for a system that is safe, prevents spills into surrounding waters, and is versatile for various sizes of vessels with different stern configurations.

A need exists for system that can dynamically react in real-time, constantly adjusting to environmental conditions, such as wind and waves, to maintain a stable distance between a floating natural gas processing station and a transport vessel, while simultaneously allowing for the transfer of people, equipment, and materials in a gangway, and while transferring liquefied natural gas to the transport vessel.

A need exists for a system to transfer hydrocarbon vapor formed during offloading of liquefied natural gas from the transport vessel back to the natural gas processing station.

A need exists for a system that can provide a quick connect and release configured to quickly connect transport vessels to a floating natural gas processing station, and to provide emergency release of the transport vessel therefrom, such as in the event of a fire, rouge wave, hurricane, 100 year storm, or other emergency situation.

The present embodiments meet these needs.

BRIEF DESCRIPTION OF THE DRAWINGS

The detailed description will be better understood in conjunction with the accompanying drawings as follows.

Figure 1A:
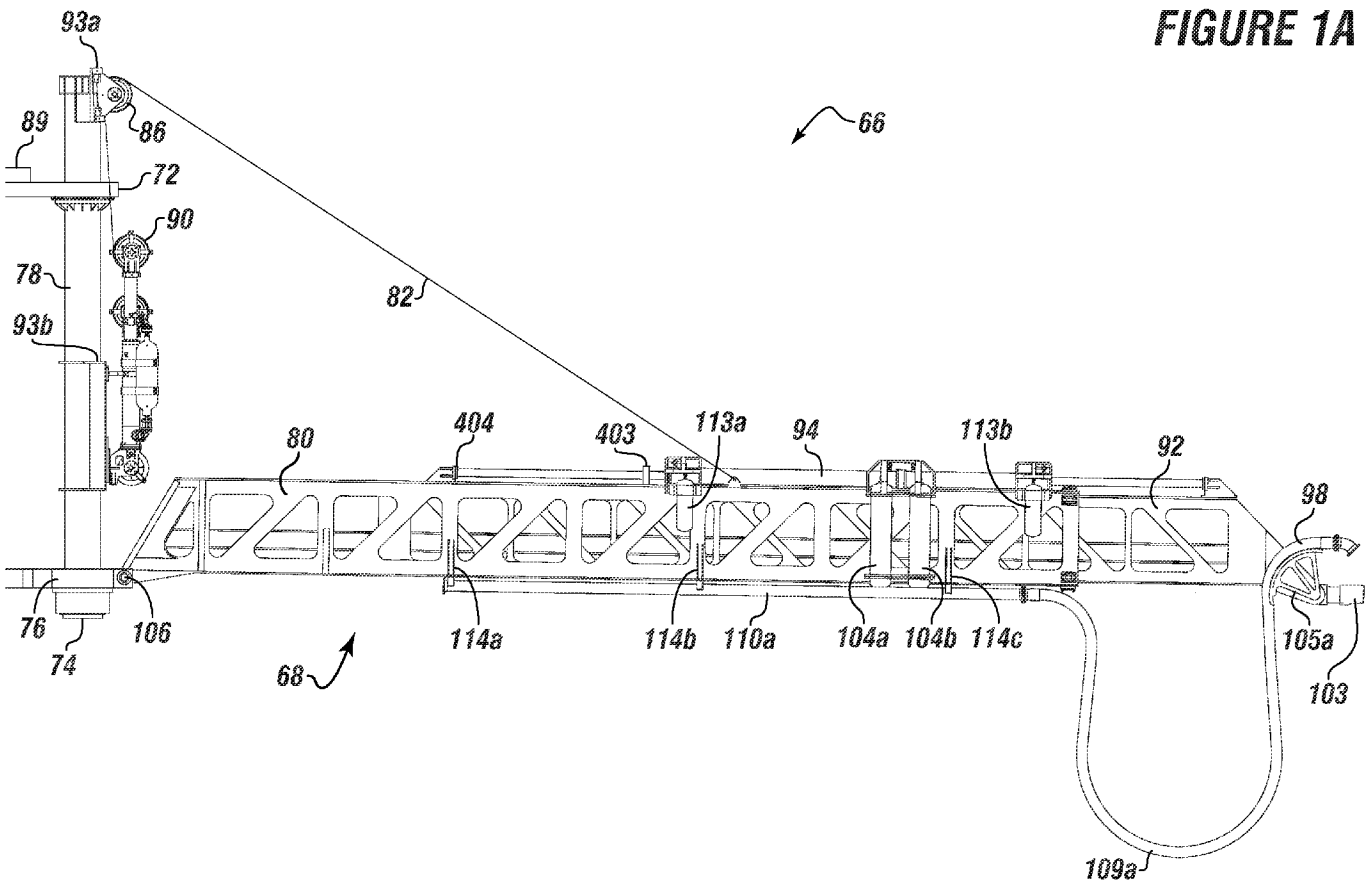
FIG. 1A depicts a first side view of a soft yoke with a boom in a second position for use on a floating station to maintain a transport vessel apart from the floating station.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments generally relate to a system for processing natural gas using a floating station, such as a natural gas processing station, having a natural gas liquefaction train. The floating station can be used to receive and process the natural gas or liquefied natural gas.

The system can also use a soft yoke for connecting the floating station to a transport vessel, such as a ship. The soft yoke that can move with waves and wind to maintain the floating station and the floating structure connected together at a safe distance.

An enclosed gangway can be formed by the soft yoke for transferring personnel, material, and equipment between the floating station and the transport vessel. The soft yoke can be mounted on the floating station, and can slidably and adjustably hold the transport vessel thereto.

The soft yoke can include quick connect/disconnect and emergency disconnect connectors to connect to the transport vessel, allowing for emergency disconnection of the transport vessel from the floating station.

The system can include a flexible liquefied natural gas offloading means and hydrocarbon vapor return means for transferring liquefied natural gas from the floating station to the transport vessel, and for transporting vapor from the transport vessel to the floating station.

The system can enable the floating station and the transport vessel to be maintained at a stable distance, even in rough waters, such as 12 foot seas, force 1 hurricane winds, and the like.

The transport vessel, such as a liquefied natural gas tanker, can have liquefied natural gas storage tanks built into its hull for receiving processed liquefied natural gas from the floating station, such as the natural gas processing station. The transport vessel can then be used to transfer the liquefied natural gas to another location. The transport vessel can be a ship with a hull, a bow, a stern, and a variable draft.

In one or more embodiments, the transport vessel can include a plurality of liquefied natural gas liquid storage tanks mounted to the hull. The storage tanks can be spherical, membrane, or prismatic type containment systems. For example, the transport vessel can have from about 1 storage tank to about 8 storage tanks. As such, the transport vessel can be used to temporarily store processed liquefied natural gas as well as to transport the processed liquefied natural gas to another location.

The storage tanks can each be independent of each other on the transport vessel. One or more embodiments can include five or six moss spherical tanks capable of storing a volume of about 125,000 cubic meters. One or more embodiments can include membrane storage tanks configured to store a volume of about 135,000 cubic meters. The membrane tanks can be maintained at ambient pressure.

The spherical or other shaped storage tanks can be maintained at cryogenic temperatures and at a pressure up to about 2.5 bar.

The transport vessel can be used to monitor and control of the offloading of the liquefied natural gas, as well as to monitor and control a flow of hydrocarbon vapor creating during offloading of the liquefied natural gas from the floating station to the transport vessel. The system can be used to quickly cease flow of fluids between the floating station and the transport vessel for safety in anticipation of a major storm, such as a hurricane or a 100 year storm.

For example, the transport vessel can have a vessel controller, such as a computer system connected to various transducers or sensors for monitoring the receipt, storage, and offloading of the liquefied natural gas.

The vessel controller can have a processor. The vessel controller can be used to monitor various offloading and other data including: a liquefied natural gas loading rate, a transport vessel draft, a liquefied natural gas temperature, a cargo tonnage, a transport vessel trim, and transport vessel motions including pitch, yaw, roll, surge, sway, and heave.

The vessel controller can compare real-time monitored data to stored data in a data storage associated with the vessel controller processor. The comparison of the real-time monitored data to the stored data can be used to initiate alarms if loading rates, pressures, temperatures, or other measured data exceed or fall below predefined limits for the transport vessel, for storage tanks on the transport vessel, or for certain weather conditions. For example, an alarm can be initiated if there is excessive pitch, yaw, roll, surge, sway, and heave, such as during a 20 knot gale.

The transport vessel can have a propulsion system for moving the transport vessel, which can be any ship propulsion system known in the art, such as steam turbine, slow speed direct drive diesel motor, or diesel electric motor. The transport vessel can be a barge with removable thrusters mounted to the barge. The transport vessel can have a navigation system for controlling the propulsion system.

The transport vessel can have a vessel station keeping device to provide dynamic positioning of the transport vessel, such as by using GPS coordinates or user preset distances from the floating station.

The vessel station keeping device can be used to maintain the transport vessel at a safe but workable distance from the floating station to permit the safe offloading of personnel, gear, liquefied natural gas, and to permit the safe return of hydrocarbon vapor formed during offloading of the liquefied natural gas.

The hydrocarbon vapor can be returned to the floating station to be re-cooled in a station heat exchanger on the floating station, such as a cold box. Then, the hydrocarbon vapor can be used as a fuel for running the floating station. The transport vessel can be configured to use the hydrocarbon vapor as a fuel to power motors or turbines of the transport vessel.

The hydrocarbon vapor can flow from the transport vessel to the floating station through a monitored vapor return flexible conduit and through a soft yoke vapor return flexible conduit, which can be on the soft yoke.

The transport vessel can be connected to the floating station using mooring sockets mounted to the hull of the transport vessel.

The floating station, or floating natural gas processing station, can have a station hull with a deck and crew quarters. The station hull can be a three or more column type floating hull. The columns can be ballasted columns for use in water, such as water that is about 200 feet deep or deeper. The station hull can be a semi-submersible hull or another type of hull.

The floating station can be connected or in fluid communication with a pretreatment source, which can be on another vessel or platform that can supply a dry gas to the floating station for processing thereon.

The pretreatment source can include a pretreatment dehydrator for removing water from natural gas to form a dehydrated gas, also referred to as a dry gas. For example, the pretreatment dehydrator can receive natural gas from a natural gas well, and can then remove water vapor before passing the dry gas to the floating station.

The pretreatment source can include a pretreatment heat exchanger that can cryogenically cool the dry gas to a first cool temperature, forming a cool dry gas, before transferring the cool dry gas to the floating station. The cryogenically cooling of the dry gas can reduce the temperature of the dry gas by at least 300 percent.

In one or more embodiments, the pretreatment source can provide a continuous flow of dry gas, or cool dry gas, to the floating station for processing into liquefied natural gas.

The dry gas can include primarily methane gas with small amounts of ethane, propane, butane, and less than 10 percent of heavier components. Approximately 65 percent of acid gas and water vapor can be removed from the natural gas when forming the dry gas, such as at the pretreatment source.

The pretreatment source can be a floating or fixed platform. The pretreatment source can have a bulk separator to remove liquid from the natural gas, an acid gas removal source to remove acid gas from the natural gas, a dehydrator to remove water vapor from the natural gas, a cryogenic plant to remove heavier hydrocarbons from the natural gas, or combinations thereof. The heavier hydrocarbons that can be removed by the cryogenic plant can include pentane, propane, and butane.

The dry gas from the pretreatment source can flow to the floating station to at least one on-board station heat exchanger on the floating station. The floating station can have multiple heat exchangers, which can be used in series or parallel to cryogenically cool the dry gas. The station heat exchanger can be a cold box, a spiral wound heat exchanger or another type of heat exchanger.

The floating station can be spread moored using from about 8 to about 12 mooring lines. The mooring lines can be wire rope, chain and wire rope, or similar material used for mooring to anchors, such as suction pile anchors, in the sea bed. The mooring spread can be configured such that at least 2 mooring lines can break while the remaining mooring lines can continue to hold the floating station in place, such as in the event of a 100 year storm.

The floating station can have a spread moored turret that can be connected to the station hull and to the mooring lines. One or more dry gas inlet conduits from the pretreatment source can be configured to enter the floating station through the spread moored turret, or the dry gas inlet conduit can pass directly to a top of the floating station without passing through the spread moored turret.

The station heat exchanger can be in fluid communication with liquefaction train or a natural gas liquefaction train. The natural gas liquefaction train can be a dual expansion nitrogen cycle assembly, a single mixed refrigerant, a dual mixed refrigerant, a cascade refrigerant, or another natural gas liquefaction train. The liquefaction train can cool the station heat exchanger, and the heat exchanger can thereby produce the liquefied natural gas from the dry gas.

The liquefied natural gas can flow from the station heat exchanger, through flexible outlet conduits on the soft yoke and the floating station, and to the transport vessel.

The flexible outlet conduits can be used to continuously flow liquefied natural gas from the floating station for offloading onto the transport vessel. The flexible outlet conduits can have a sensor that can be connected to a station controller that can monitor temperature, pressure, and flow rates of the flowing liquefied natural gas.

To provide high safety at sea, the floating station can have a primary quick connect/disconnect connector to quickly engage the transport vessel, a secondary emergency disconnect connector for quickly disengaging the transport vessel, and a tertiary emergency disconnect connector to allow the transport vessel to quickly slip away from the floating station.

The primary quick connect/disconnect connector and the secondary emergency disconnect connector can be formed on a same side of the station hull. The primary quick connect/disconnect connector and the secondary emergency disconnect connector can function to secure the soft yoke mooring arms to the transport vessel.

The primary quick connect/disconnect connector, secondary emergency disconnect connector, and tertiary emergency disconnect connector can be configured to quickly connect transport vessels to the floating station and to provide emergency release of the transport vessels therefrom, such as by using comparisons with sensed data from the station controller.

The station controller can monitor and control onboard processes including offloading processes. For example, the station controller can monitor and control the dry gas inlet conduit, the station heat exchanger, the offload flexible conduits, and the vapor return flexible conduits for pressures, temperatures, and flow rates to determined if the pressures, temperatures, and flow rates fall below or exceed preset limits.

The station controller can control the dry gas inlet conduit, such as by being connected to an emergency shut off device and initiating the emergency shut off device as required.

The station controller can monitor the station heat exchanger by monitoring rates of temperature change, flow rates of pre-cooled gas, temperature and flow rates of refrigerant used in the station heat exchanger.

The station controller can monitor the vapor return flexible conduits by monitoring the vapor return rates, vapor temperatures, and vapor pressures therein.

The soft yoke can be used to hold the transport vessel and provide for offloading of the liquefied natural gas, and for return of the hydrocarbon vapor. The soft yoke can be made of steel, aluminum, a composite, or another structural material.

The soft yoke can have one or more telescoping mooring arms. A stiffness of the telescoping mooring arms can operate within a range from about 2.5 tons per foot to about 10 tons per foot. The telescoping mooring arms can each have a length from about 50 feet to about 150 feet, and a width from about 7 feet to about 14 feet. However, the size of the telescoping mooring arms can be different depending upon the particular application. The telescoping mooring arms can be perforated, allowing for wind to flow through the soft yoke. The telescoping mooring arms can be made from welded tubular steel.

Each telescoping mooring arm can have an upper connecting mount for engaging the floating station. The upper connecting mount can be a rotational mount and can include a gear for rotating the soft yoke relative to the floating station.

Each telescoping mooring arm can have a lower connecting mount for engaging the floating station. The lower connecting mount can be a rotational mount and can include a gear for rotating the soft yoke relative to the floating station.

Each telescoping mooring arm can have a turn table connected to the lower connecting mount, which can provide a walking surface for the telescoping mooring arms, allowing personnel to walk around.

Each telescoping mooring arm can have a pivoting structural anchoring point for a boom of the telescoping mooring arm, enabling the boom to pivot up and away from the deck of the floating structure, and allowing each telescoping mooring arm to move to a collapsed position, providing a safer floating station, and a floating station that is less likely to turn over.

Each telescoping mooring arm can have a king post engaged with the turn table and the upper connecting mount. The turn table can be configured to rotate with the king post.

Each telescoping mooring arm can have a boom connected to the turn table and to at least one wire or luffing wire. The luffing wires can be made of composite fiber or steel. Each luffing wire can be engaged with a turn down sheave, which can be mounted to the king post.

Each luffing wire can engage a tensioner. Each tensioner can be a hydraulic cylinder accumulator assembly, which can function as a pneumatic tensioning device for the luffing wire. The tensioner can be configured to apply tension to and release tension from the luffing wires, which can connect to a jib. Slack can be provided to luffing wires that engage between the jib and tensioners.

Each telescoping mooring arm can have a jib. The jib can be telescopically disposed within the boom in a nested configuration, allowing the jib to slide in and out of the boom without completely exiting the boom.

The jib and the boom can be designed to dynamically react to environmental conditions, such as wind and waves, to extend and retract the jib within the boom to maintain a stable distance between the floating station and the transport vessel.

The jib and the boom can also allow for the transfer of people, loads of materials, and equipment in a gangway formed by the jib and the boom.

The dimensions of the jib can be 80 percent the dimensions of the boom. The dimensions of the jib can be from about 7 feet to about 14 feet wide, and from about 50 feet to about 100 feet long.

The jib can be connected to at least one centralizing cylinder, which can include a hydraulic accumulator. The centralizing cylinder can operate to control the position of the jib within the boom. For example, the centralizing cylinders can be configured to extend and retract the jib relative to the boom. The centralizing cylinders apply a pressure on the jib for sliding out the jib from the boom. The centralizing cylinder can have a capacity ranging from about 200 psi to about 2000 psi, or any psi depending upon the application.

The jib can extend to a maximum extension or retract to a minimum retraction relative to the boom. The jib extension and retraction can be adjusted to account for wave motion, current motion, wind motion, transport vessel dynamics, floating natural gas processing station dynamics, changes in draft, other motions, and other such variables, such as by using a yoke controller. As such, the jib can be operated to maintain a nominal standoff position within preset limits for holding the transport vessel within predefined distances from the floating station.

The gangway can be formed by the jib and the boom when the jib is engaged within the boom. The gangway can be an enclosed gangway with openings. The gangway can support movement of personnel and equipment of up to 800 pounds between the transport vessel and the floating station.

Each telescoping mooring arm can have a yoke flexible offload conduit for communicating fluid, such as the liquefied natural gas, from the floating station to the transport vessel.

In operation, once the transport vessel is connected to the floating station, the yoke flexible offload conduit can communicate with one or more storage tanks on the transport vessel, and the fluid can be pumped, or can otherwise flowed, from the floating station to the storage tanks.

Each telescoping mooring arm can have a yoke vapor return flexible conduit for communicating hydrocarbon vapor formed during offloading of the fluid back to the floating station for use in running the liquefaction train, fueling a station power plant, fueling the floating station, or for recycling back into the station heat exchanger for reprocessing.

For example, during the flowing of the liquefied natural gas to the storage tanks, a vapor can be formed. The yoke vapor return flexible conduit can receive the formed vapor and flows the formed vapor from the transport vessel to the floating station for reprocessing, or for use as a fuel.

The soft yoke can extend the boom and jib to any length required to maintain a predefined distance between the transport vessel and the floating station. For example, the soft yoke can maintain a predefined distance within a range of +/−5 feet, +/−30 feet, or any other required distance.

A soft yoke controller or the station controller can be used to control the soft yoke to provide dynamic positioning of the floating station, the transport vessel, or both, thereby controlling the distance between the floating station and the transport vessel and/or controlling a location of the transport vessel relative to a preset longitude and latitude.

Figure 1B:
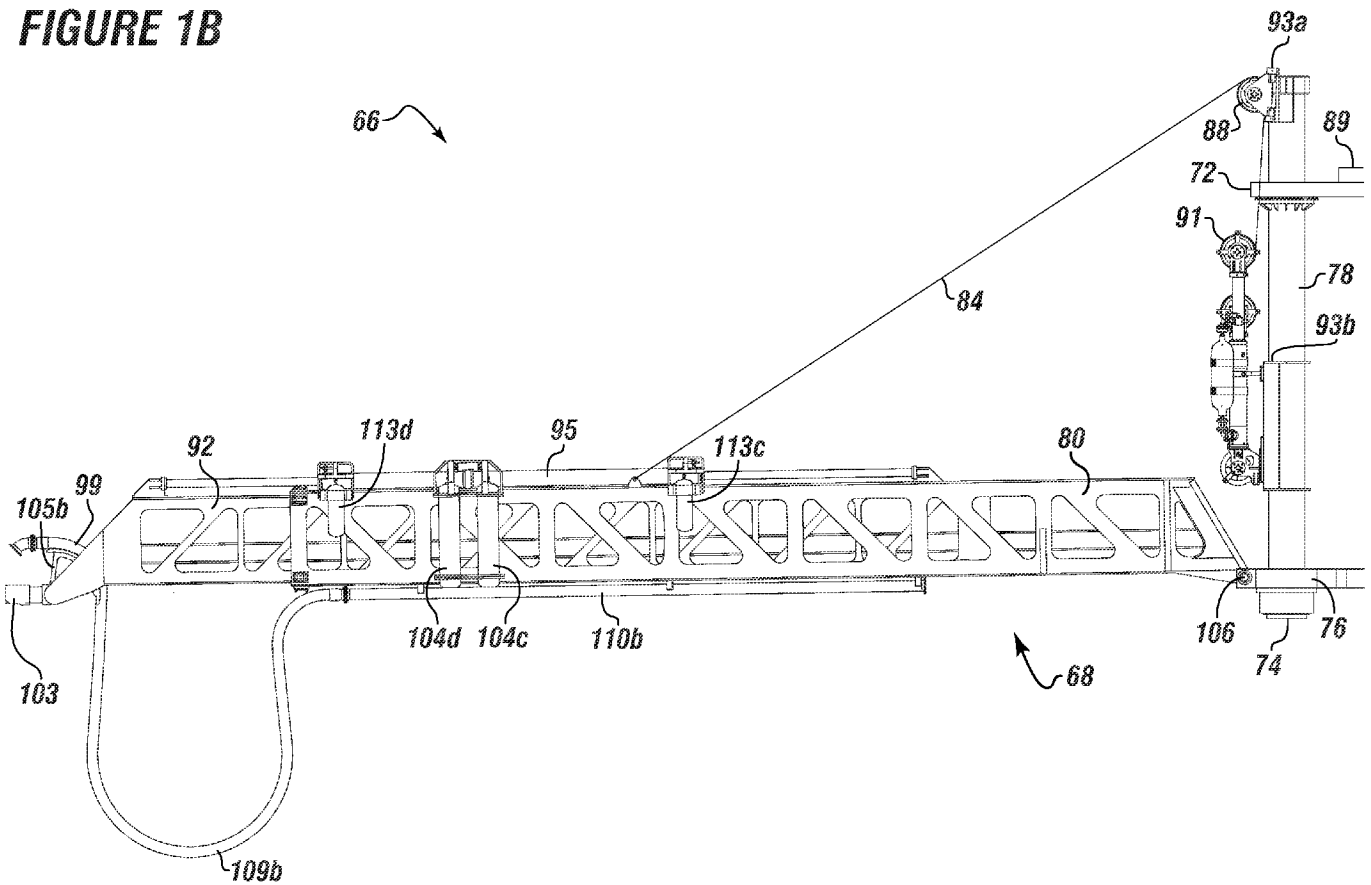
FIG. 1B shows a second side view of the soft yoke with the boom in the second position.

FIG. 1A depicts a side view of a soft yoke 66 with a first telescoping soft yoke mooring arm 68. FIG. 1B shows the opposite side of the soft yoke 66 shown in FIG. 1A.

Referring now to both FIGS. 1A and 1B, the first telescoping soft yoke mooring arm 68 can include an upper connecting mount 72 for engaging a floating natural gas processing station, a fixed or floating vessel, a floating structure, or the like.

The first telescoping soft yoke mooring arm 68 can include a lower connecting mount 74 for engaging the floating natural gas processing station, fixed or floating vessel, floating structure, or the like.

The upper connecting mount 72 and the lower connecting mount 74 can have a diameter from about 48 inches to about 84 inches, and can be made of powder coated steel.

The first telescoping soft yoke mooring arm 68 can be actuated by a soft yoke controller 89, which can be in communication with a station controller (shown in FIG. 3A), or the first telescoping soft yoke mooring arm 68 can be actuated by the station controller.

The soft yoke 66 can include a turn table 76 connected to the lower connecting mount 74. The dimensions of the turn table 76 can be from about 9 feet to about 12 feet in diameter. The turn table 76 can have a thickness from about 12 inches to about 24 inches, and can be made of steel with an internal bearing of bronze or another frictionless material.

The soft yoke 66 can include a king post 78 that engages with the turn table 76, the upper connecting mount 72, and the lower connecting mount 74. The turn table 76 can be configured to rotate with the king post 78. The king post 78 can be connected to a first tensioner 90 and a second tensioner 91 by a tensioner mount 93*b*.

The king post 78 can be made of steel, and can have a length of from about 12 feet to about 50 feet and a diameter from about 3 feet to about 6 feet. The king post 78 can be a rolled tube with a hollow portion.

The soft yoke 66 can have a boom 80 connected to the turn table 76. The boom 80 can have a length from about 40 feet to about 140 feet, a height from about 8 feet to about 14 feet, and a width from about 8 feet to about 16 feet.

In embodiments, the boom 80 can be a tubular. The boom 80 can have a diameter from about 14 feet to about 16 feet. The boom 80 can include hollow tubulars welded together to reduce cost in shipping. The boom 80 can be configured to not fail upon impacts and slams, which can occur to the floating natural gas processing station to which the boom 80 is attached. For example, the boom 80 can be configured to not fail upon impacts and slams during a 20 year storm, according the US Coast Guard classification of a 20 year storm with wave sizes of up to 12 feet and a frequency of from about 2 feet to about 3 feet.

A heel pin 106 can connect the boom 80 to the turn table 76, allowing the boom 80 to rotate relative to the turn table 76. A typical heel pin can be machined from cold drawn high strength steel shafting, and can have a length from about 6 inches to about 18 inches and a diameter from about 6 inches to about 12 inches. The boom 80 can be locked into the turn table 76 using a collet and locking pin.

Figure 1C:
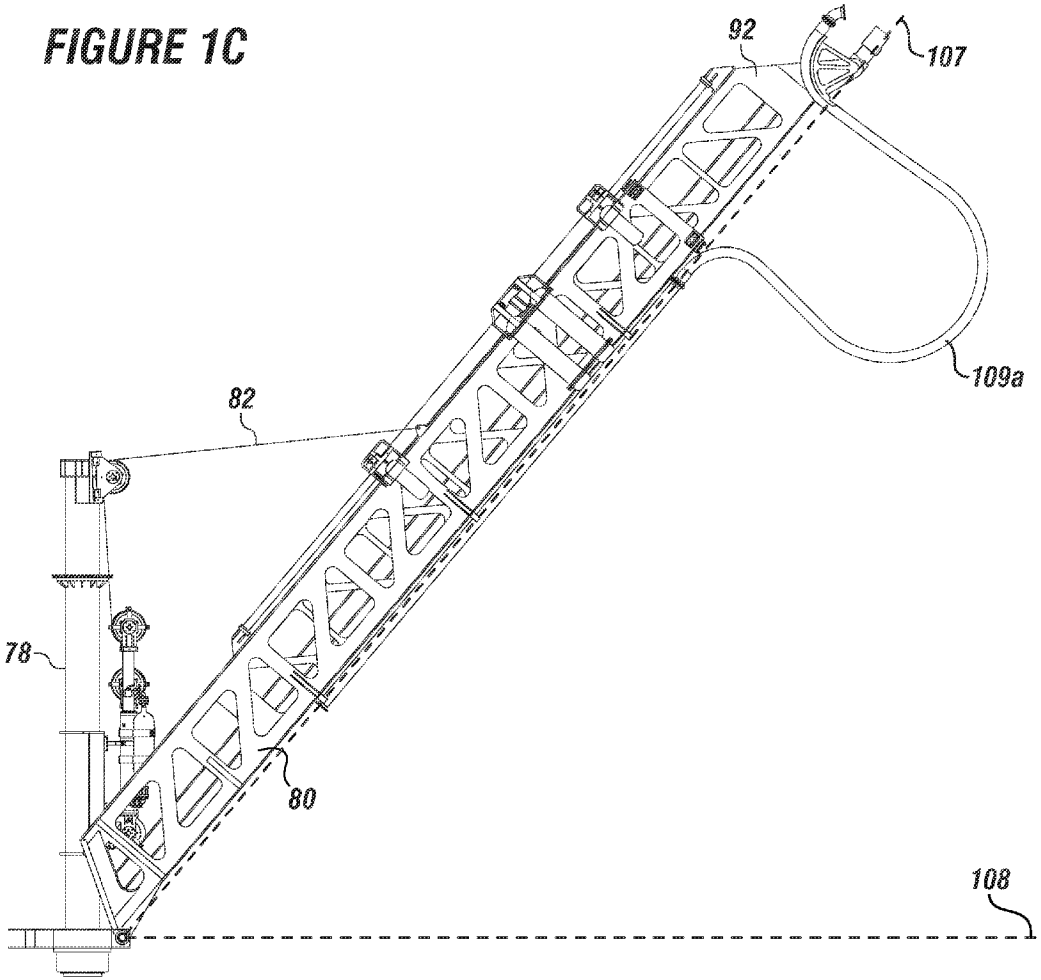
FIG. 1C shows a side view of the soft yoke in a first retracted position.

As such, the boom 80 can pivot from a first position, such as with the boom 80 extending to a substantially parallel position with the king post 78 (which is shown in FIG. 1C at about a 45 degree angle), to a second position, such as with the boom 80 extending substantially perpendicular to the king post 78. The boom 80 can pivot to any position between the first position and the second position, such as by using a first luffing wire 82 and a second luffing wire 84. The boom 80 is depicted in the second position in FIGS. 1A-1B.

The first luffing wire 82 and the second luffing wire 84 can each connect to the boom 80 at one end and to the king post 78 at the opposite end. The first luffing wire 82 can engage a first turn down sheave 86 mounted to the king post 78. The second luffing wire 84 can engage a second turn down sheave 88 mounted to the king post 78. The first and second turn down sheaves 86 and 88 can be mounted to the king post 78 with a sheave mount 93*a*.

The first luffing wire 82 can extend from the first turn down sheave 86 to the first tensioner 90, which can function to apply and release tension to the first luffing wire 82. The amount of tension applied to the first luffing wire 82 can be an amount sufficient to hold the first telescoping soft yoke mooring arm 68 or greater. The second luffing wire 84 can extend from the second turn down sheave 88 to the second tensioner 91, which can function to apply and release tension to the second luffing wire 84. The amount of tension applied to the second luffing wire 84 can be an amount sufficient to hold the first telescoping soft yoke mooring arm 68 or greater.

For example, in operation the first and second tensioners 90 and 91 can be used to apply tension to the first and second luffing wires 82 and 84, allowing the boom 80 to be raised towards the first position with an upward movement away from any deck of a transport vessel. When the first and second tensioners 90 and 91 release tension from the first and second luffing wires 82 and 84, the boom 80 can be lowered towards the second position with a downward movement towards a surface of the sea and towards a deck of a transport vessel.

A jib 92 can be nested within the boom 80, allowing the jib 92 to have an extended position and a retracted position, and enabling the jib 92 to be telescopically contained within the boom 80. The jib 92 can be a tubular. The jib 92 can have a diameter ranging from about 12 feet to about 14 feet. The tubulars of the jib 92 can be made of hollow tubular steel.

The jib 92 can be controlled by at least one centralizing cylinder, such as a first centralizing cylinder 94 and a second centralizing cylinder 95.

The first and second centralizing cylinders 94 and 95 can control a position of the jib 92 within the boom 80. For example, the first and second centralizing cylinders 94 and 95 can be mounted in parallel on the opposite sides of the boom 80 to extend and retract the jib 92 within the boom 80.

The soft yoke 66 can connect between a floating gas processing station or the like and a transport vessel or the like. As such, the soft yoke 66 can be used to accommodate for environmental factors that can shift a position of the transport vessel, the floating natural gas processing station, the soft yoke 66, the like, or combinations thereof, to allow for continuous loading of liquefied natural gas, and to allow for safe transfer of people and equipment over a gangway formed using the soft yoke 66.

The soft yoke 66 can provide for higher levels of safety by maintaining safe distances using computer controlled devices between the transport vessel and the floating natural gas processing station and the like, and by providing for quick connects and emergency disconnects in case of fire, high winds, or rogue waves. The environmental factors can include wave motions, current motions, wind, transport vessel dynamics or the like, floating natural gas processing station dynamics or the like, changes in draft, and other such external and internal variables.

The first and second centralizing cylinders 94 and 95 can each be hydraulic or pneumatic cylinders, or combinations thereof, and can be connected to one or more accumulators 104*a*, 104*b*, 104*c*, and 104*d*. Any number of accumulators can be used.

The first and second centralizing cylinders 94 and 95 can extend and retract the jib 92 to maintain the transport vessel or the like at a nominal standoff position within preset limits from the floating natural gas processing station or the like.

The soft yoke 66 can prevent disconnection of any conduits communicating between the floating natural gas processing station and the transport vessel or the like, by maintaining the correct spacing therebetween.

Preset distances or limits from the floating natural gas processing station or the like can be any distance required for the particular application. The preset limits can be any allowable range of variation from the predefined distance required for the particular application. For example, in an application with a nominal distance of one hundred feet, and a preset limit of plus or minus ten feet, the first and second centralizing cylinders 94 and 95 can operate to extend and retract the jib 92 to maintain the nominal standoff position from about ninety feet to about one hundred ten feet. The nominal standoff position can be a length of the boom 80 plus a length of the jib 92 extending from the boom 80.

The soft yoke 66 can include conduits for flowing fluid between floating natural gas processing stations and transport vessels or the like. For example, the soft yoke 66 can include a yoke offload flexible conduit 98 and a yoke vapor return flexible conduit 99. The yoke offload flexible conduit 98 can be used to flow fluid, such as liquefied natural gas, from the floating natural gas processing stations to waiting transport vessels or the like. The fluid can be a liquefied natural gas or another liquid.

The yoke offload flexible conduit 98 can flow the fluid from the floating natural gas processing station into storage tanks on the transport vessel. The transport vessel can receive, store, transport, and offload the fluid.

The yoke vapor return conduit 99 can flow hydrocarbon vapor formed during offloading of the fluid back from the transport vessel to the floating natural gas processing station. For example, the yoke vapor return flexible conduit 99 can be in fluid communication with a station heat exchanger (shown in FIG. 5). The station heat exchanger can be a cold box, for receiving the formed vapor and cooling the vapor for reprocessing using a station mounted liquefaction train (also shown in FIG. 5). The hydrocarbon vapor can serve as a fuel supply for the floating natural gas processing station or the like.

The yoke offload flexible conduit 98 and the yoke vapor return conduit 99 can each be made from about eight inch to about ten inch diameter rigid pipe, or from a similar diameter flexible composite cryogenic hose, or combinations thereof. The yoke offload flexible conduit 98 and the yoke vapor return conduit 99 can be any size or material as required for the particular application, given particular flow rates, pressures, and storm conditions. For example, the yoke offload flexible conduit 98 and the yoke vapor return conduit 99 can be 3 inch or larger diameter reinforced hose, a draped hose, or a festooned hose.

The yoke offload flexible conduit 98 can have a jib flexible portion 109*a*, and the yoke vapor return flexible conduit 99 can have a jib flexible portion 109*b*. The jib flexible portions 109*a* and 109*b* can allow the yoke offload flexible conduit 98 and the yoke vapor return conduit 99 to move easily along with the boom 80 as the jib 92 expands and retracts within the boom 80. Since the boom 80 can be raised and lowered using the first and second tensioners 90 and 91, the jib flexible portions 109*a* and 109*b* can enable the yoke offload flexible conduit 98 and the yoke vapor return conduit 99 to have enough range of motion and flexibility to move with the boom 80 without fracturing or being over tensioned.

The yoke offload flexible conduit 98 can have a first rigid portion 110*a*, and the yoke vapor return flexible conduit 99 can have a second rigid portion 110*b*. The rigid portions 110*a* and 110*b* can provide a rigid connection between the yoke offload flexible conduit 98, the yoke vapor return conduit 99, and the boom 80, allowing the boom 80 to securely move the yoke offload flexible conduit 98 and the yoke vapor return conduit 99 as the boom 80 moves.

The yoke offload flexible conduit 98 and the yoke vapor return flexible conduit 99 can be secured to the boom 80, such as by gussets 105*a* and 105*b*, and support structures 114*a*, 114*b*, and 114*c*. Each support structure114*a*, 114*b*, and 114 and gusset 105*a* and 105*b* can be pivotable and/or rotatable.

The soft yoke 66 can include one or more low pressure fluid accumulators 113*a*, 113*b*, 113*c*, and 113*d* for the first and second centralizing cylinders 94 and 95. The one or more low pressure accumulators 113*a*, 113*b*, 113*c*, and 113*d* can have a pressure from about 30 psi to about 300 psi each.

The soft yoke 66 can include a connection interface 103 for connecting the soft yoke 66 to the transport vessel or the like. For example, the connection interface 103 can be a primary quick connect/disconnect connector with a secondary emergency disconnect connector and a tertiary disconnect connector that engages a mooring socket on a transport vessel.

The soft yoke 66 can include a stop 404 configured to selectively engage a hydraulic actuator switch 404. For example, the stop 404 can be located on the boom 80, and the hydraulic actuator switch 403 can be located on the jib 92.

FIG. 1C depicts the boom 80 connected to the king post 78 with the first luffing wire 82. The first luffing wire 82 can hold the boom 80 in a first position 107. The second position 108 also is depicted. The boom 80 can be lowered to the second position 108. Also shown is the jib 92 and the jib flexible portion 109*a*.

Figure 2A:
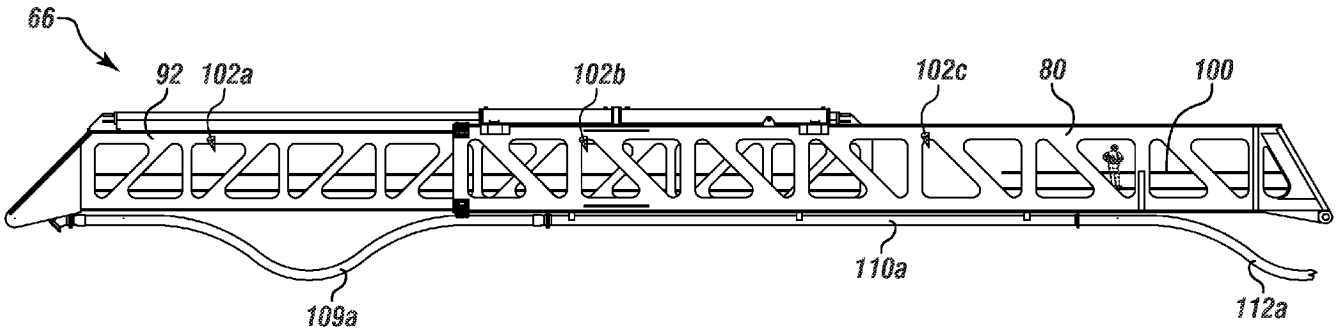
FIG. 2A depicts a side view of a portion of the soft yoke in an extended position.

FIG. 2A depicts the soft yoke 66 with the jib 92 and the boom 80 nested together. A secure enclosed gangway 100 can be formed that allows wind and water to pass through the secure enclosed gangway 100 without deforming, and allows people to pass between the transport vessel and the floating station or the like.

The secure enclosed gangway 100 can have openings 102*a*, 102*b*, and 102*c*, which can provide ventilation and allow spray and wind to pass through the secure enclosed gangway 100 without pulling a person into the sea.

The secure enclosed gangway 100 can function to allow for personnel to move between transport vessel and floating natural gas processing stations when the soft yoke 66 is connected therebetween. The secure enclosed gangway 100 can be made of aluminum, steel, or another material. The secure enclosed gangway 100 can have an anti-slip tread, handrails, lighting, and other safety features.

The jib 92 is depicted in a partially extended position relative to the boom 80 with the jib flexible portion 109*a* slightly tensioned as it connects to the rigid portion 110*a*. The rigid portion 110*a* is shown connected to the boom flexible portion 112*a*.

The boom flexible portion 112*a* can allow the conduits of the soft yoke 66 to move extend and retract along with the jib 92. For example, when the jib 92 is extended and retracted using the centralizing cylinders, the boom flexible portion 112*a* can provide the conduits with enough range of motion and flexibility to extend and retract with the jib 92 without fracturing or being over tensioned.

Figure 2B:
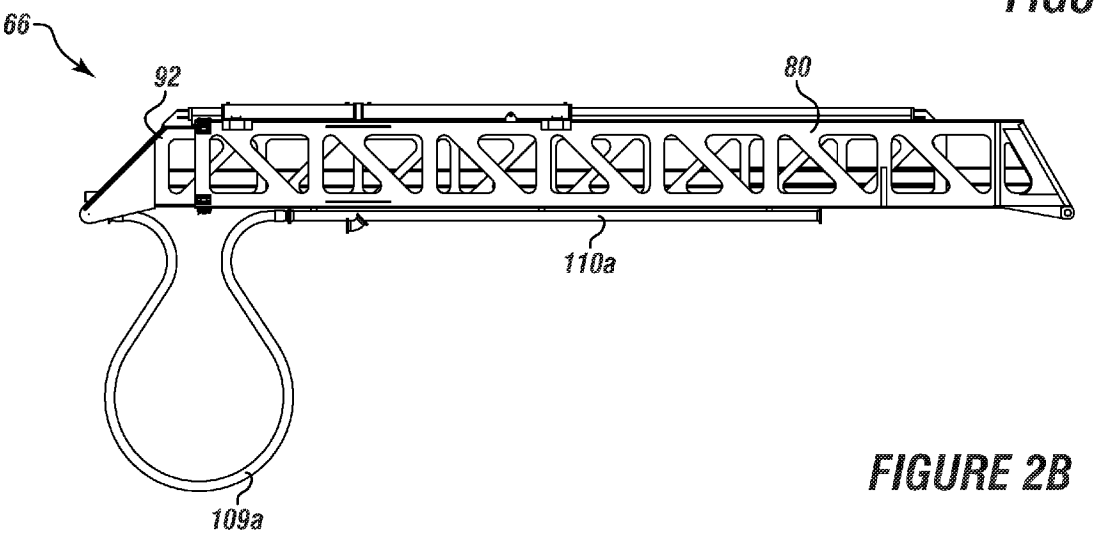
FIG. 2B depicts a side view of a portion of the soft yoke in a retracted position.

FIG. 2B depicts the same side view of a portion of the soft yoke 66 as FIG. 2A with the jib 92 depicted in a retracted position relative to the boom 80. The jib flexible portion 109*a* is depicted connected to the rigid portion 110*a*, with little or no tension, having an extra "scope" or lengths in a loop.

The jib flexible portion 109*a* is configured to have a length sufficient to have enough range of motion and flexibility to extend and retract along with the jib 92. The boom flexible portion can be configured the same as the jib flexible portion 109*a*, and can function in the same manner.

Figure 2C:
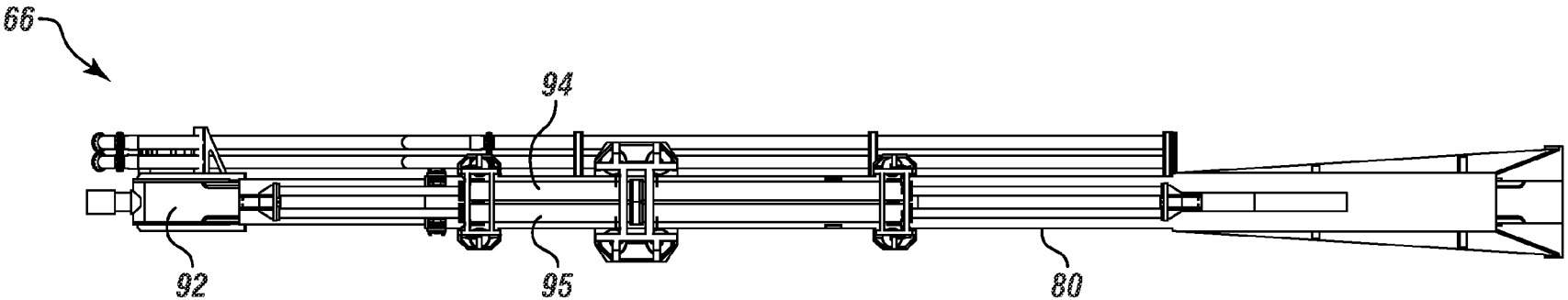
FIG. 2C depicts a top view of a portion of the soft yoke in the extended position.

FIG. 2C depicts a top view of a portion of the soft yoke 66 having the first and second centralizing cylinders 94 and 95 configured to actuate for extending and retracting the jib 92 relative to the boom 80.

Figure 3A:
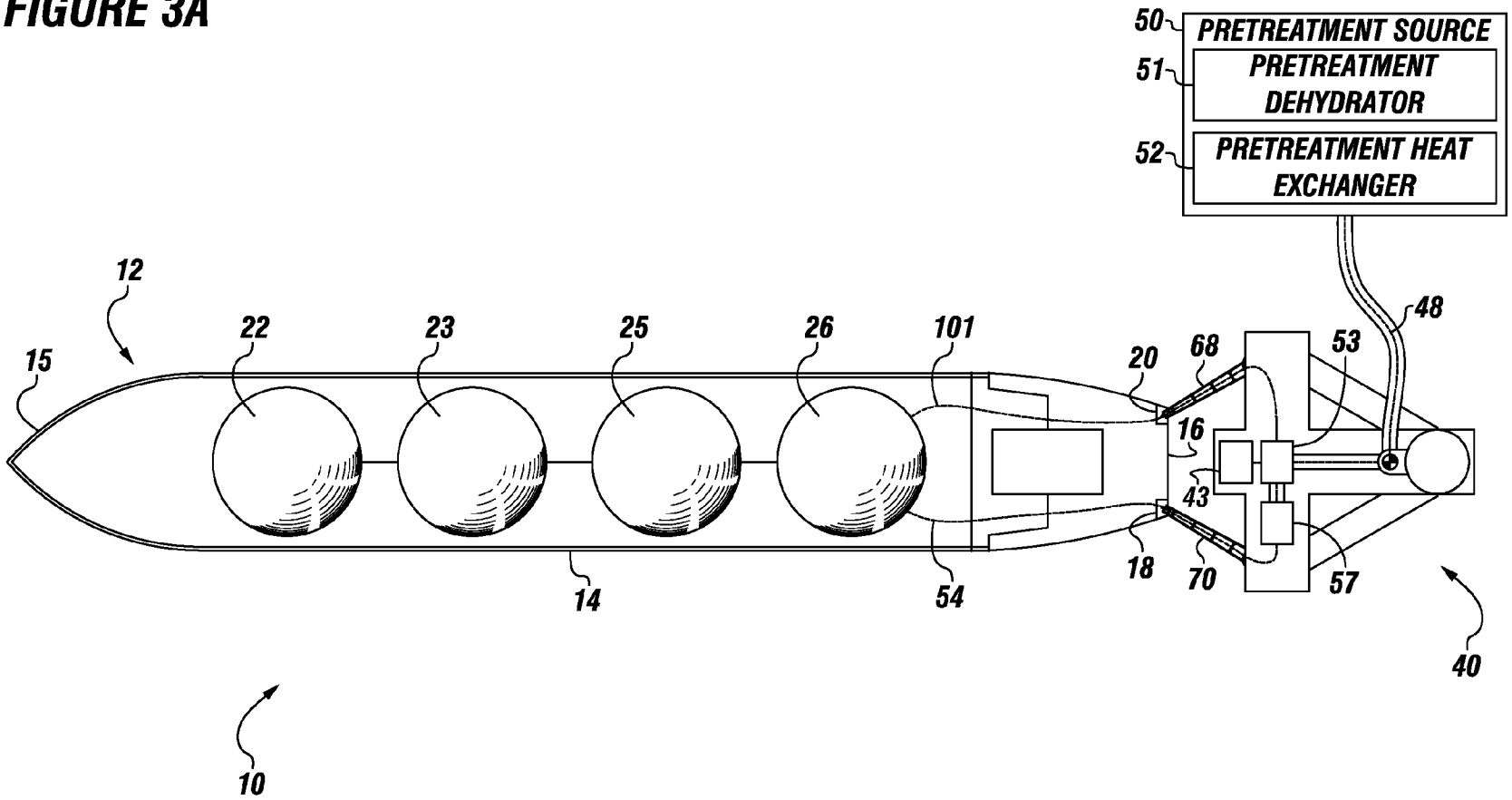
FIG. 3A depicts two soft yoke mooring arms connecting between a floating station and a transport vessel.

FIG. 3A depicts a top view of a system 10 with the first telescoping soft yoke mooring arm 68 and a second telescoping soft yoke mooring arm of 70 connecting the floating natural gas processing station 40 to a transport vessel 12. The transport vessel 12 can have a vessel hull 14 between a bow 15 and stern 16. The floating natural gas processing station 40 is depicted as a semisubmersible structure.

In one or more embodiments, the first and second telescoping soft yoke mooring arms 68 and 70 can connect directly to the stern 16 of the transport vessel 12, with the first and second telescoping soft yoke mooring arms 68 and 70 both angled inwards towards the stern 16. First and second mooring sockets 18 and 20 can connect the first and second telescoping soft yoke mooring arms 68 and 70 to stern 16.

A station heat exchanger 53 can be connected to a pretreatment source 50 for receiving dry gas 48 from the pretreatment source 50.

The pretreatment source 50 can have a pretreatment dehydrator 51 and a pretreatment heat exchanger 52. Accordingly, the pretreatment source 50 can be configured to cool and dry natural gas from a wellbore or other source.

The liquefied natural gas 54 can flow from station offload flexible conduits, which are also termed "offload flexible conduits" herein, through the yoke offload conduits to liquefied natural gas storage tanks 22, 23, 25, and 26 on the transport vessel 12.

A hydrocarbon vapor 101 can flow from the transport vessel 12, through yoke vapor return flexible conduits, through station vapor return flexible conduits, and to the station heat exchanger 53.

A station controller 43 can be located on the floating natural gas processing station 40 to control one or more components thereof. The floating natural gas processing station 40 can include one or more liquefaction trains 57 in communication with the station heat exchanger 53.

Figure 3B:
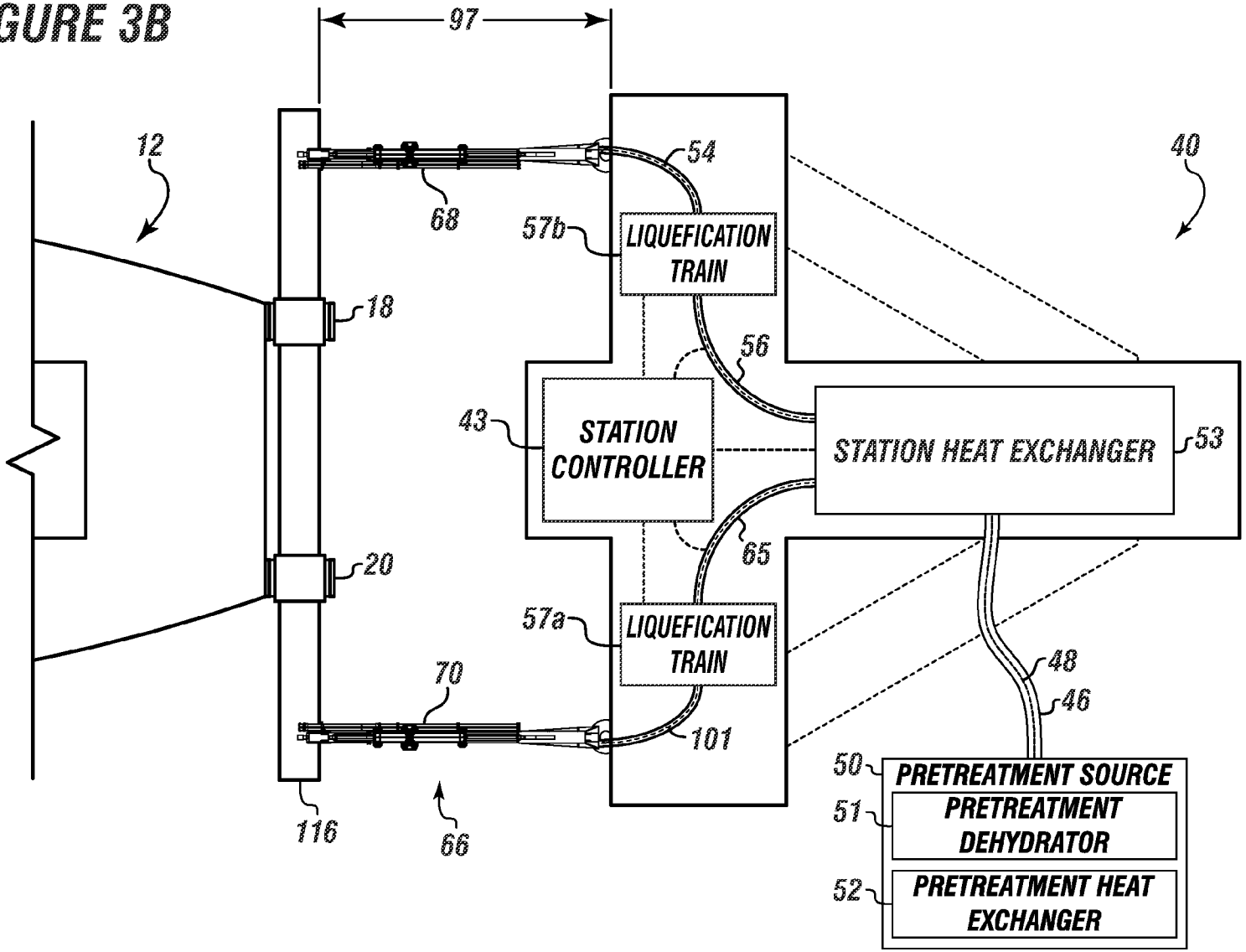
FIG. 3B depicts two soft yoke mooring arms connected to a docking bar removably connected to a transport vessel.

FIG. 3B depicts an embodiment of a floating natural gas processing station 40 connected to a transport vessel 12 using the soft yoke 66 with a first telescoping soft yoke mooring arm 68 and a second telescoping soft yoke mooring arm 70 connected to a docking bar 116. The docking bar 116 can connect to the transport vessel 12 via first and second morning sockets 18 and 20.

The station controller 43 can control flow of liquefied natural gas 54, hydrocarbon vapor 101, and can control the station heat exchanger 53.

The transport vessel 12 can be positioned at a nominal standoff position 97 relative to the floating natural gas processing station 40. In one or more embodiments, the first and second telescoping soft yoke mooring arms 68 and 70 can be connected directly to the transport vessel 12 or to the docking bar 116, allowing versatility of connection for vessels with small narrow sterns, and for vessels with larger, wider sterns.

The pretreatment source 50 can communicate with the station heat exchanger 53 via inlet conduit 46, allowing dry gas 48 to flow to the station heat exchanger 53 after passing through the pretreatment heat exchanger 52 and the pretreatment dehydrator 51.

The liquefied natural gas 54 can flow from the floating natural gas processing station 40, through an offload flexible conduit 56 and through corresponding yoke offload flexible conduits on the soft yoke 66 to the transport vessel 12.

The hydrocarbon vapor 101 can return from the transport vessel 12 through yoke vapor return flexible conduits on the soft yoke and through a corresponding vapor return flexible conduit 65 on the floating natural gas processing station 40.

The liquefaction trains 57*a* and 57*b* can functions to cool the station heat exchanger 53. The liquefied natural gas 54 and the hydrocarbon vapor 101 can flow through the liquification trains 57*a* and 57*b* between the transport vessel 12 and the station heat exchanger 53.

Figure 4A:
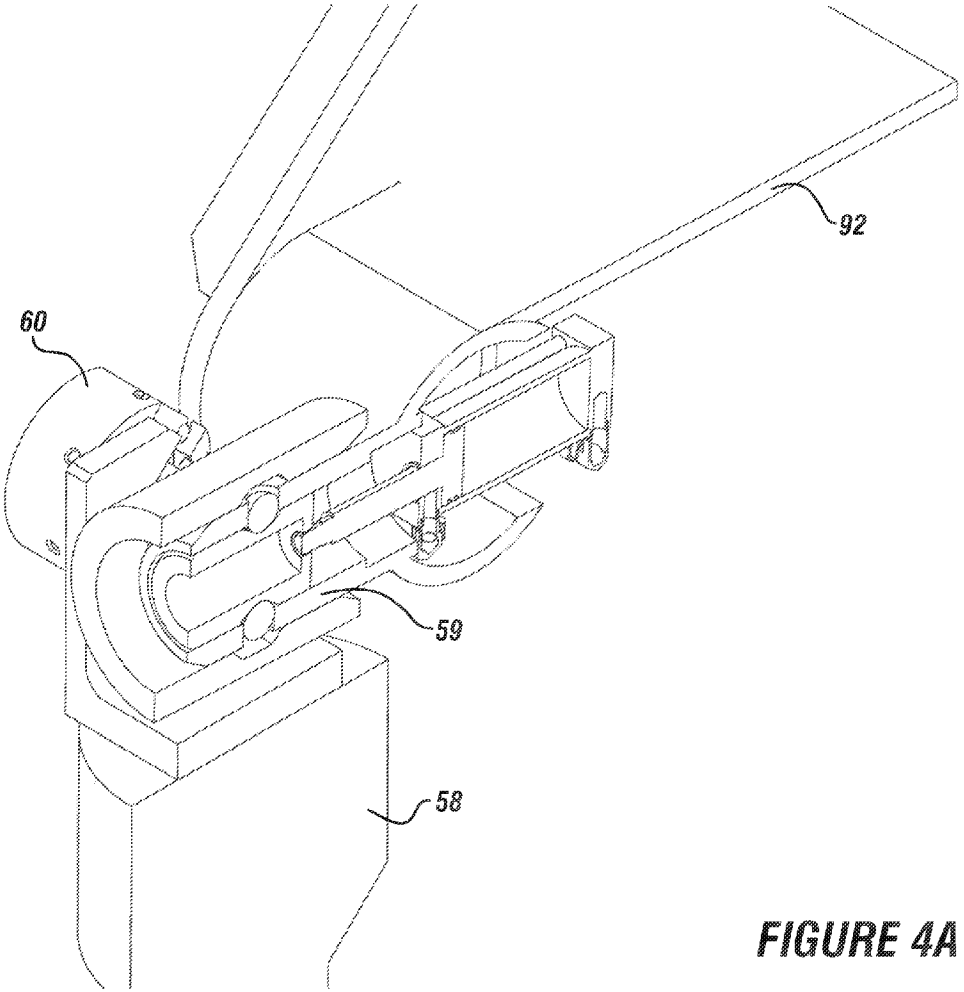
FIG. 4A depicts a cut away view of a secondary emergency disconnect connector along with a primary quick release connector and a tertiary emergency disconnect release connector.

FIG. 4A shows the three connectors usable with the system, the primary quick connect/disconnect connector 58, the secondary emergency disconnect connector 59 and the tertiary emergency disconnect connector 60 that connect to the jib 92.

The primary quick connect/disconnect connector 58 can engage a mooring socket on the transport vessel. Hydraulic cylinders can force the quick connect/disconnect connector 58 into the mooring socket.

Figure 4B:
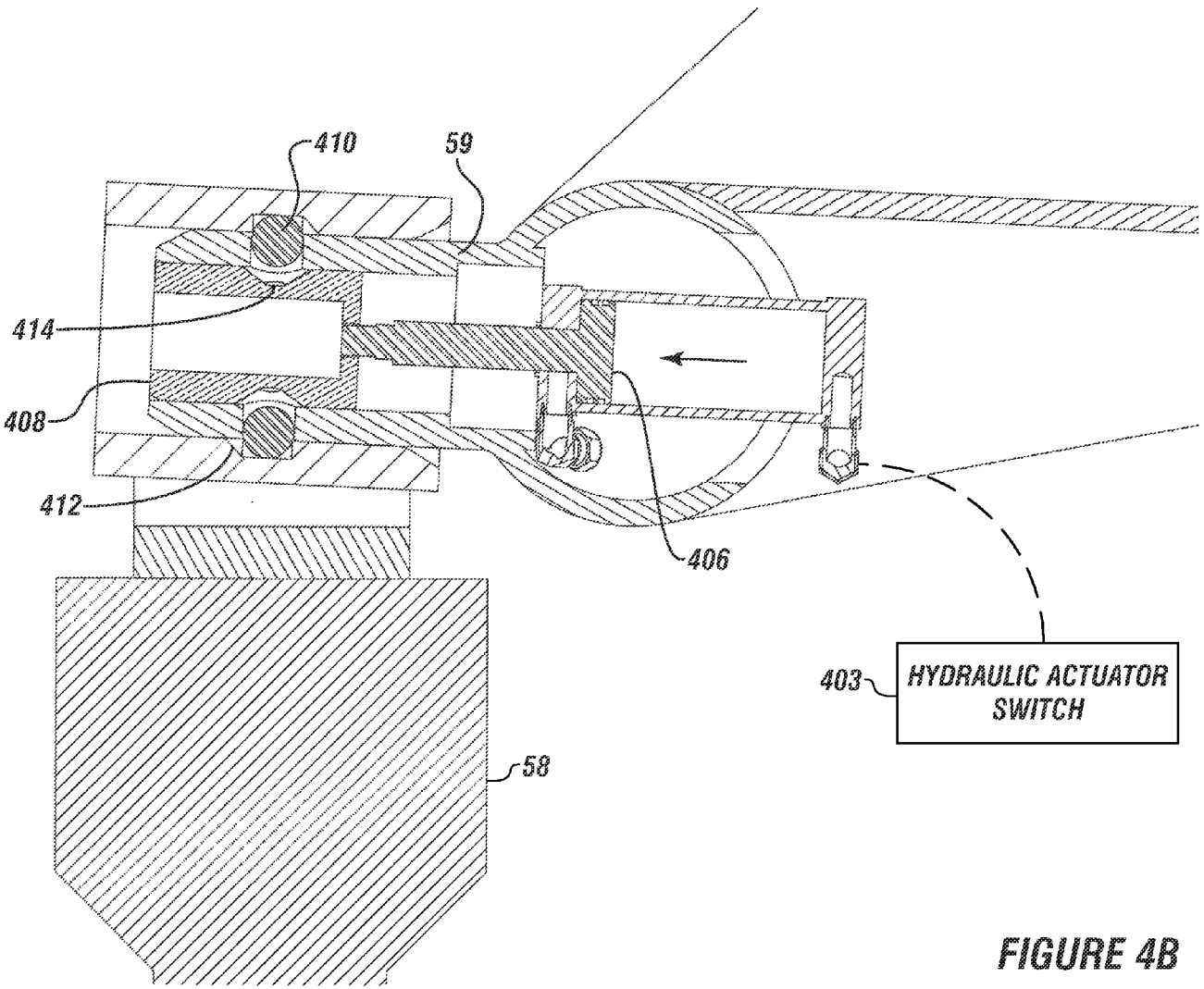
FIG. 4B shows a detailed view of the secondary emergency disconnect connector.

FIG. 4B depicts in detail the secondary emergency disconnect connector 59 engaging between the tip of the jib and a first lock release 408 to allow the jib and boom assembly to disconnect and slide away from the primary quick connect/disconnect connector 58.

The secondary emergency disconnect connector 59 can be operatively engaged with an emergency actuator 406, which can be operatively engaged with a hydraulic actuator switch 403. The first lock release 408 can have a pin recess 414 for operatively engaging the emergency actuator 406. Quick release bearings 410 can be disposed between the first lock release 408 and a locking recess sleeve 412.

In operation, the secondary emergency disconnect connector 59 can connect the soft yoke to the transport vessel. A stop can be configured to engage the hydraulic actuator switch 403 when the jib has reached a maximum extension length relative to the boom. The hydraulic actuator switch 403 can be configured to flow hydraulic fluid to the hydraulic actuator 406 upon engagement with the stop. The hydraulic actuator 406 can receive the flowing fluid from the hydraulic actuator switch 403. The hydraulic actuator 406 can push the first lock release 408 upon receipt of the fluid from the hydraulic actuator switch 403.

The first lock release 408 can then disengage the quick release bearings 410 and release the telescoping soft yoke mooring arms from the transport vessel. The quick release bearings 410 move from being engaged within a locking recess sleeve 412 to within a pin recess 414, thereby releasing the soft yoke from the transport vessel.

Figure 5:
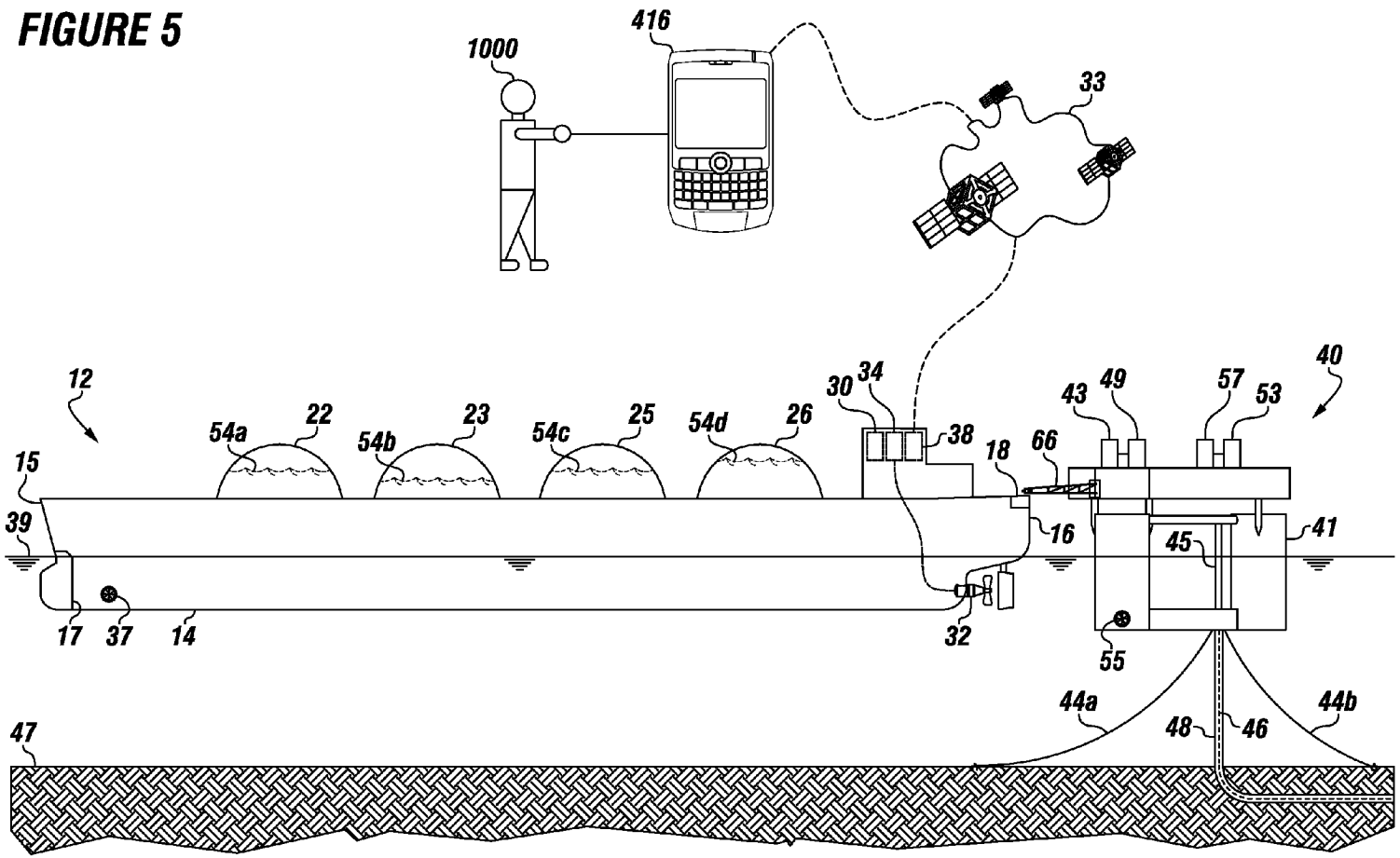
FIG. 5 depicts a soft yoke connecting between a transport vessel and a floating station along with a user in communication with a network.

FIG. 5 depicts a floating natural gas processing station 40 with a soft yoke 66 and a spread moored turret 45. The spread moored turret 45 can be moored to the sea bed 47 with mooring lines 44*a* and 44*b*.

A dry gas inlet conduit 46 can extend into the spread moored turret 45 for communicating dry gas 48 from a pretreatment source for processing on the floating natural gas processing station 40 with a natural gas liquefaction train 57.

The spread moored turret 45 allows the floating natural gas processing station 40 to weather vane according to weather conditions, wind direction, and waves. For example, the spread moored turret 45 allows the floating natural gas processing station 40 to pivot and/or rotate about the spread moored turret 45, while the spread moored turret 45 is fixed by the mooring lines 44*a* and 44*b*.

The floating natural gas processing station 40 can be a ballasted floating vessel with a station hull 41 with a station variable draft.

In embodiments, the floating natural gas processing station 40 can use heading controls 49 connected to thrusters 55, allowing the floating natural gas production station 40 to dynamically maintain position with the transport vessel 12 using GPS positioning with other dynamic positioning equipment to maintain space between the floating natural gas processing station 40 and the transport vessel 12.

A vessel controller 43 can be connected to the heading controls 49 and the station thrusters 55.

The stern 16 of the transport vessel 12 can connect directly to the boom of the soft yoke 66. For example, a first mooring socket 18 can connect to the soft yoke 66. Pivot can be employed with the soft yoke 66 to rotate the mooring arms of the soft yoke 66, allowing the liquefied natural gas 54*a*, 54*b*, 54*c*, and 54*d* to flow into the storage tanks 22, 23, 25, and 26 from the natural gas liquefaction train 57 and/or the station heat exchanger 53.

The transport vessel 12 is shown having a hull 14 with a variable draft 17, allowing the transport vessel 12 to change draft and balance with respect to sea level 39 to be capable of receiving and offloading the processed liquefied natural gas 54*a*-54*d*.

The transport vessel 12 can have a bow 15 opposite the stern 16, with the storage tanks 22, 23, 24, 25, and 26 located on the hull 14. The storage tanks 22, 23, 24, 25 and 26 can be independent of each other.

The transport vessel 12 can include a vessel controller 30 with a processor and data storage for monitoring data associated with the receipt of the processed liquefied natural gas 54*a*-54*d*, the storage of the processed liquefied natural gas 54*a*-54*d*, and the offloading the processed liquefied natural gas 54*a*-54*d* from the transport vessel 12.

The transport vessel 12 can include a propulsion system 32 for moving the transport vessel 12 and a navigation system 34 for controlling the propulsion system 32.

The transport vessel 12 can have a station keeping device 38 that operates dynamic positioning thrusters 37. The station keeping device 38 and the navigation system 34 can communicate with a network 33, shown here as a satellite network, for dynamic positioning of the floating vessel 12. Client devices 416 with computer instructions can communicate with the network 33, allowing a remote user 1000 to monitor the processing, storage, and offloading.

Figure 6A:
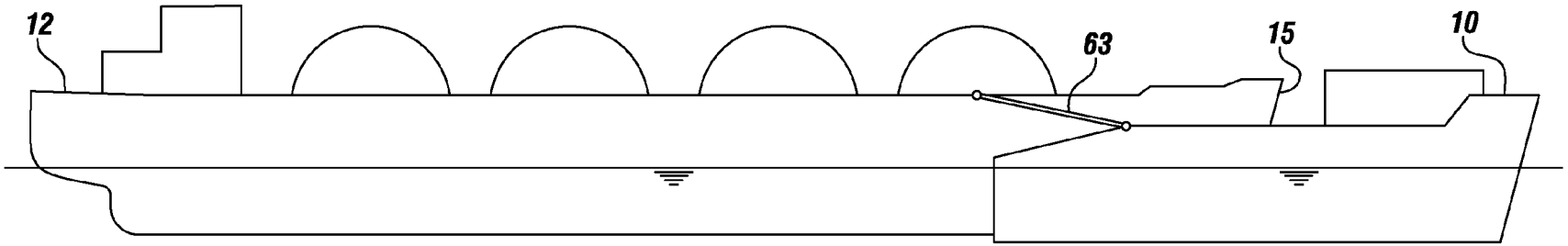
FIG. 6A depicts a side view of a transport vessel connected to a floating station using a docking notch and at least one mooring arm.
Figure 6B:
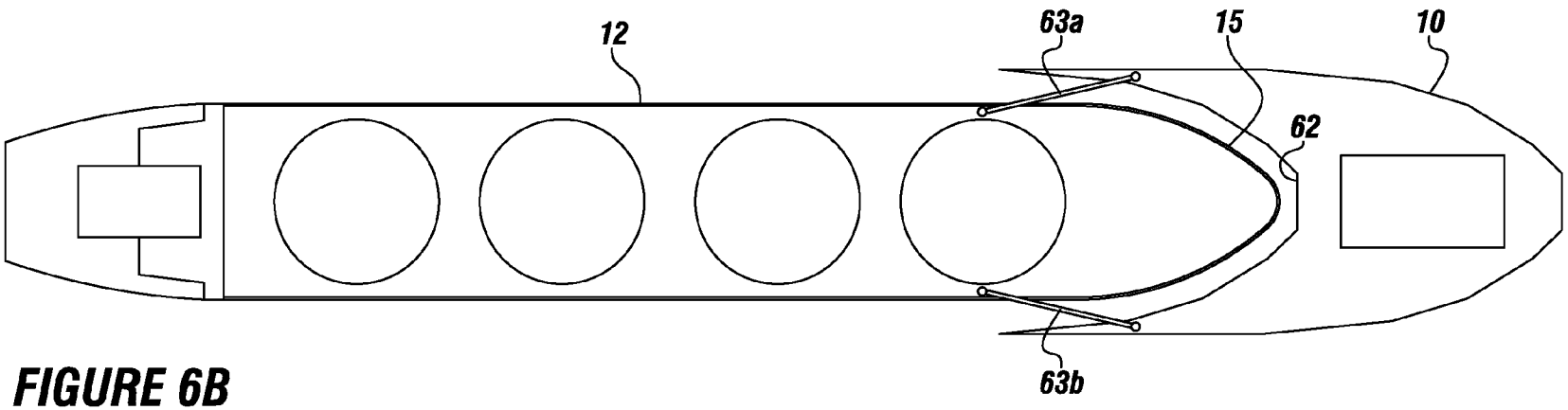
FIG. 6B depicts a top view of the embodiment of FIG. 6A.

FIGS. 6A and 6B depict an embodiment for connecting a transport vessel 12 and a floating natural gas processing station 10. The floating natural gas processing station 10 is depicted as a floating vessel without propulsion, such as a barge. The floating natural gas processing station 10 can have a docking notch 62 for accepting the bow 15 of the transport vessel 12. Mooring arms 63, 63*a*, and 63*b* are shown connected to the station hull of the floating natural gas processing station 10 for holding the transport vessel 12 in the docking notch 62.

The floating natural gas processing station 10 can have a station variable draft and can be ballasted like the transport vessel 12.

Figure 7:
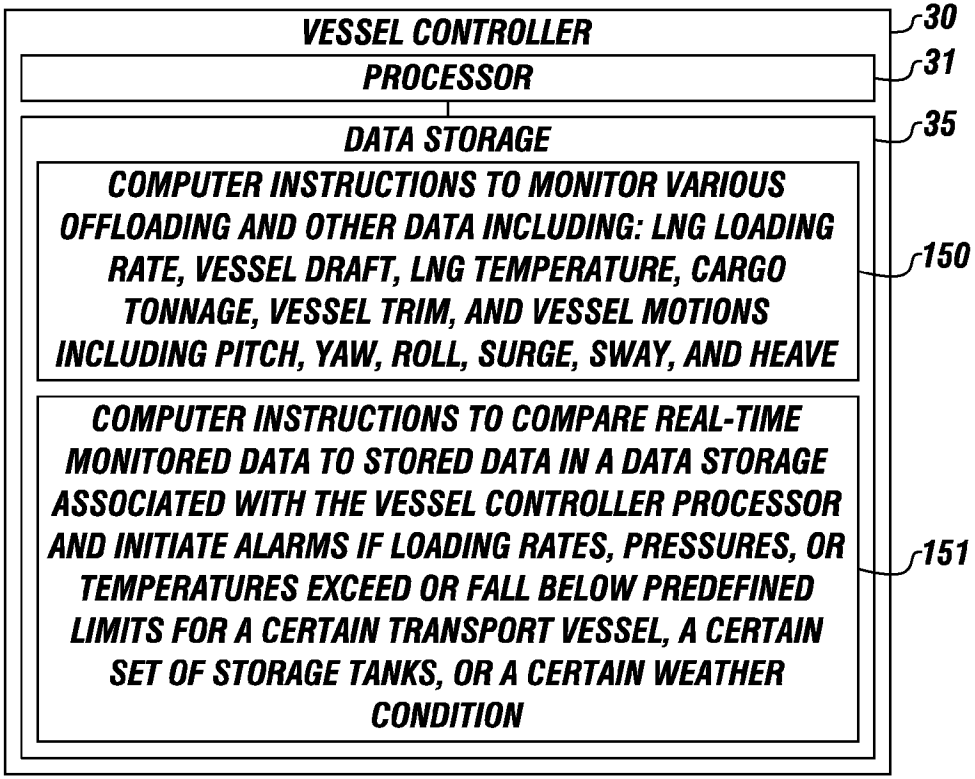
FIG. 7 depicts an embodiment of a vessel controller.

FIG. 7 depicts an embodiment of a vessel controller 30 with a processor 31 and a data storage 35.

The data storage 35 can have computer instructions 150 to monitor various offloading and other data including: LNG loading rate, vessel draft, LNG temperature, cargo tonnage, vessel trim, and vessel motions including pitch, yaw, roll, surge, sway, and heave.

The data storage 35 can have computer instructions 151 to compare real-time monitored data to stored data in a data storage associated with the vessel controller processor and initiate alarms if loading rates, pressures, or temperatures exceed or fall below predefined limits for a certain transport vessel, a certain set of storage tanks, or a certain weather condition.

Figure 8:
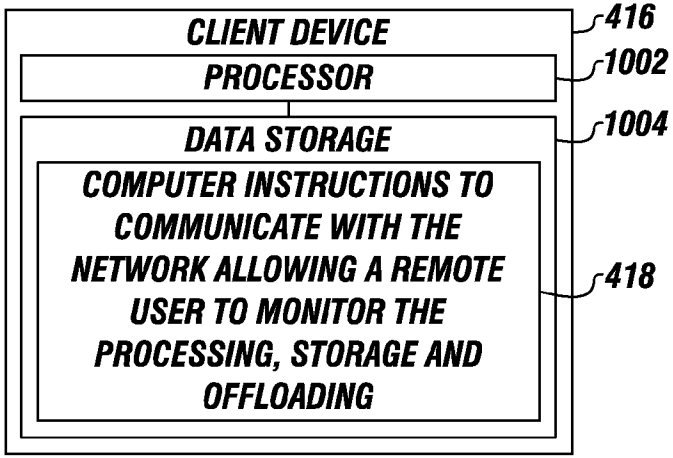
FIG. 8 depicts an embodiment of a client device.

FIG. 8 depicts an embodiment of a client device 416 with a processor 1002 and a data storage 1004. The data storage 1004 can have computer instructions 418 to communicate with the network allowing a remote user to monitor the processing, storage and offloading.

While these embodiments have been described with emphasis on the embodiments, it should be understood that within the scope of the appended claims, the embodiments might be practiced other than as specifically described herein.

What is claimed is:

1. A natural gas processing station and transport system for receiving, storing, and transporting liquefied natural gas, the system comprising:

a. a transport vessel for receiving liquefied natural gas, temporarily storing the liquefied natural gas, and transporting the liquefied natural gas to another location, wherein the transport vessel comprises:
   (i) a hull with a bow, a stern, and a variable draft;
   (ii) at least one mooring socket mounted to the hull;
   (iii) a plurality of storage tanks mounted within the hull for receiving and storing the liquefied natural gas; and
   (iv) a vessel controller for monitoring: receipt of the liquefied natural gas, storage of the liquefied natural gas in the storage tanks, and offloading of the liquefied natural gas from the storage tanks;

b. a natural gas processing station, wherein the natural gas processing station comprises:
   (i) a station hull with a station variable draft;
   (ii) a plurality of mooring lines, connecting the station hull with a seabed;
   (iii) a dry gas inlet conduit for receiving a dry gas from a pretreatment source;
   (iv) a station heat exchanger for receiving the dry gas from the pretreatment source;

(v) a liquefaction train for cooling the station heat exchanger and forming the liquefied natural gas;

(vi) an offload flexible outlet conduits for flowing the liquefied natural gas from the station heat exchanger;

(vii) a vapor return flexible conduit for communicating hydrocarbon vapor formed during offloading back to the natural gas processing station from the transport vessel, wherein the vapor return flexible conduit communicates with the station heat exchanger; and (viii) a station controller for monitoring the dry gas inlet conduit, the station heat exchanger, and the flexible outlet conduit, and for actuating a primary quick connect/disconnect connector, a secondary emergency disconnect connector, and a tertiary emergency disconnect connector; and c. a soft yoke for connecting the transport vessel to the natural gas processing station, wherein the soft yoke comprises at least two telescoping soft yoke mooring arms, and wherein each telescoping soft yoke mooring arm comprises:

(i) the primary quick connect/disconnect connector for engaging the at least one mooring bracket of the transport vessel, and the secondary emergency disconnect connector to allow quick connect/disconnect or emergency disconnect of the transport vessel, wherein the tertiary emergency disconnect connector additionally allows emergency disconnect of the transport vessel;

(ii) an upper connecting mount engaging the soft yoke with the natural gas processing station;

(iii) a lower connecting mount engaging the soft yoke with the natural gas processing station;

(iv) a turn table connected to the lower connecting mount;

(v) a king post engaged with the turn table and the upper connecting mount;

(vi) a boom connected to the turn table and to at least one luffing wire, wherein each luffing wire engages a turn down sheave mounted to the king post;

(vii) a tensioner for each luffing wire;

(viii) a jib telescopically contained within the boom and connected to at least one centralizing cylinder for controlling a position of the jib within the boom when the natural gas processing station and the transport vessel are connected together and are affected by wave motion, current motion, wind motion, transport vessel dynamics, natural gas processing station dynamics, or combinations thereof, wherein the jib assists in maintaining a nominal standoff position holding the transport vessel at a predefined distance from the natural gas processing station, and wherein the jib and the boom form a gangway for moving personnel between the transport vessel and the natural gas processing station;

(ix) a yoke offload flexible conduit for flowing the liquefied natural gas from the natural gas processing station; and (x) a yoke vapor return flexible conduit for flowing the hydrocarbon vapor from the transport vessel formed during offloading back to the natural gas processing station.

2. The system of claim 1, wherein the at least one centralizing cylinder is a pneumatic cylinder connected to an accumulator.

3. The system of claim 1, wherein the boom is pivotably connected to the turn table.

4. The system of claim 3, wherein the boom is pivotably connected to the turn table using at least one heel pin.

5. The system of claim 1, wherein the mooring lines connect with a spread moored turret that allows the natural gas processing station to weather vane according to weather conditions, wind direction, and wave direction.

6. The system of claim 1, wherein the station hull is a semisubmersible.

7. The system of claim 1, wherein the natural gas processing station further comprises a docking notch for accepting the bow of the transport vessel and a mooring arm for holding the hull of the transport vessel within the docking notch.

8. The system of claim 1, wherein the soft yoke is made of steel or aluminum.

9. The system of claim 1, wherein the turn table is configured to rotate about the king post.

10. The system of claim 1, wherein the boom is configured to pivot from a first position to a second position, and to any position between the first position and the second position.

11. The system of claim 1, wherein each tensioner is configured to apply and release tension to one of the luffing wires.

12. The system of claim 1, wherein the at least one of the centralizing cylinder is configured to extend and retract the jib.

13. The system of claim 1, wherein each of the yoke offload flexible conduit and the yoke vapor return flexible conduit each comprise:

a. a jib flexible portion allowing the yoke offload flexible conduit and the yoke vapor return flexible conduit to move with the boom;

b. a rigid portion providing a rigid connection between the yoke offload flexible conduit and the yoke vapor return flexible conduit and the boom, and allowing the boom to securely move the yoke offload flexible conduit and the yoke vapor return flexible conduit as the boom moves; and c. a boom flexible portion allowing the yoke offload flexible conduit and the yoke vapor return flexible conduit to extend and retract along with the jib.

14. The system of claim 1, wherein the telescoping soft yoke mooring arms are made of aluminum, steel, or another material capable of sustaining human weight or other loads.

15. The system of claim 1, wherein the station hull is at least a three column connected hull.

16. The system of claim 1, wherein the dry gas is cooled in a pretreatment heat exchanger prior to flowing to the natural gas processing station.

17. The system of claim 16, wherein the station heat exchanger and the pretreatment heat exchanger are each a cold box, or a spiral wound heat exchanger for cryogenic cooling of the dry gas.

18. The system of claim 1, further comprising station thrusters mounted to the natural gas processing station and connected to heading controls for dynamically positioning the natural gas processing station relative to the transport vessel.

19. The system of claim 1, further comprising using a docking bar secured to the stern of the transport vessel enabling the telescoping soft yoke mooring arms to hold the transport vessel at a predetermined distance from the natural gas processing station.

20. The system of claim 1, wherein the secondary emergency disconnect connector comprises:

a. a hydraulic actuator switch disposed on the boom;

b. a stop disposed on the jib configured to engage the hydraulic actuator switch when the jib has reached a maximum extension length relative to the boom, wherein the hydraulic actuator switch is configured to flow hydraulic fluid to a hydraulic actuator upon engagement with the stop, and wherein the hydraulic actuator pushes the first lock release upon receipt of the hydraulic fluid from the hydraulic actuator switch; and c. quick release bearings, wherein the first lock release disengages the quick release bearings and releases the telescoping soft yoke mooring arms from the transport vessel.

21. The system of claim 1, wherein the vessel controller has computer instructions to monitor various offloading and other data including: LNG loading rate, vessel draft, LNG temperature, cargo tonnage, vessel trim, and vessel motions including pitch, yaw, roll, surge, sway, and heave.

22. The system of claim 21, wherein the vessel controller has computer instructions to compare real-time monitored data to stored data in a data storage associated with the vessel controller processor and initiate alarms if loading rates, pressures, or temperatures exceed or fall below predefined limits for a certain transport vessel, a certain set of storage tanks, or a certain weather condition.

* * * * *